US009080578B2

(12) United States Patent
Beers et al.

(10) Patent No.: US 9,080,578 B2
(45) Date of Patent: Jul. 14, 2015

(54) COMPACT DRIVE FOR COMPRESSOR VARIABLE DIFFUSER

(75) Inventors: Craig M. Beers, Wethersfield, CT (US); John M. Beck, Granby, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 2003 days.

(21) Appl. No.: 12/202,609

(22) Filed: Sep. 2, 2008

(65) Prior Publication Data

US 2010/0054923 A1 Mar. 4, 2010

(51) Int. Cl.

| | |
|---|---|
| ***F04D 29/56*** | (2006.01) |
| ***F04D 25/06*** | (2006.01) |
| ***F04D 25/08*** | (2006.01) |
| ***F04D 27/02*** | (2006.01) |
| ***F04D 29/46*** | (2006.01) |

(52) U.S. Cl.

CPC ..... *F04D 25/06* (2013.01); *F04D 25/08* (2013.01); *F04D 27/0246* (2013.01); *F04D 29/462* (2013.01)

(58) Field of Classification Search

CPC ..... F04D 25/06; F04D 27/0246; F04D 25/08
USPC ..... 415/150
See application file for complete search history.

(56) References Cited

U.S. PATENT DOCUMENTS

| | | | | |
|---|---|---|---|---|
| 2,428,830 | A * | 10/1947 | Rudolph Birmann | 60/792 |
| 2,739,782 | A * | 3/1956 | White | 415/17 |
| 3,124,931 | A * | 3/1964 | Mock | 60/791 |
| 3,209,537 | A * | 10/1965 | Mock | 60/792 |
| 3,243,159 | A * | 3/1966 | Hefler et al. | 415/156 |
| 3,372,862 | A * | 3/1968 | Koenig, III | 415/27 |
| 3,612,403 | A * | 10/1971 | Baghdadi | 239/265.37 |
| 3,799,694 | A | 3/1974 | Duzan | |
| 3,963,369 | A | 6/1976 | Balje | |
| 4,405,290 | A | 9/1983 | Rannenberg | |
| RE31,835 | E * | 2/1985 | Rannenberg | 417/282 |
| 4,579,507 | A * | 4/1986 | Corrigan et al. | 415/150 |
| 4,657,476 | A | 4/1987 | Berg | |
| 4,780,049 | A | 10/1988 | Palmer | |
| 5,242,265 | A * | 9/1993 | Hora et al. | 416/26 |
| 5,324,164 | A * | 6/1994 | Doering et al. | 415/150 |
| 5,620,301 | A * | 4/1997 | Lawer | 415/150 |
| 6,039,534 | A * | 3/2000 | Stoner et al. | 415/162 |
| 6,679,057 | B2 * | 1/2004 | Arnold | 60/602 |
| 6,865,891 | B2 * | 3/2005 | Walsh et al. | 60/792 |
| 6,928,818 | B1 * | 8/2005 | Arnold et al. | 60/602 |
| 7,189,059 | B2 * | 3/2007 | Barton et al. | 415/186 |

(Continued)

FOREIGN PATENT DOCUMENTS

| | | |
|---|---|---|
| EP | 1413763 | 8/2006 |
| GB | 731822 | 6/1955 |

(Continued)

*Primary Examiner* — Fernando L Toledo
*Assistant Examiner* — Victoria K Hall
(74) *Attorney, Agent, or Firm* — Carlson, Gaskey & Olds P.C.

(57) ABSTRACT

A compressor has an impeller and an inlet delivering air to the impeller. A variable diffuser is positioned downstream of the impeller and includes a plurality of pivoting vanes. A drive arrangement pivots the vanes, and includes an electric motor causing a pinion gear to rotate. The pinion gear has gear teeth engaging gear teeth on a rack section. Rotation of the rack section causes the vanes to pivot.

2 Claims, 3 Drawing Sheets

(56) References Cited

U.S. PATENT DOCUMENTS

| | | | | |
|---|---|---|---|---|
| 2002/0158517 | A1* | 10/2002 | Rouse et al. | 307/151 |
| 2006/0062666 | A1* | 3/2006 | McAuliffe et al. | 415/191 |
| 2006/0133926 | A1* | 6/2006 | Bouru | 415/160 |
| 2007/0166150 | A1* | 7/2007 | Szucs et al. | 415/160 |
| 2010/0129204 | A1* | 5/2010 | Higashimori et al. | 415/148 |
| 2010/0172745 | A1* | 7/2010 | Hodder | 415/163 |

FOREIGN PATENT DOCUMENTS

| | | |
|---|---|---|
| GB | 913147 | * 12/1962 |
| GB | 2065235 | 6/1981 |

* cited by examiner

COMPACT DRIVE FOR COMPRESSOR VARIABLE DIFFUSER

BACKGROUND OF THE INVENTION

This application relates to a drive for a compressor diffuser.

Diffusers are utilized to control an outlet cross-sectional flow area in a compressor. Variable diffusers include a plurality of vanes that can be pivoted to change the cross-sectional flow area between minimum and maximum amounts.

In one recently developed diffuser, disclosed in U.S. patent application Ser. No. 11/108,286, a ring is driven by a mechanical connection to rotate. When the ring rotates, it carries pins that are received within diffuser vanes. The diffuser vanes pivot as the ring rotates, and thus the cross-sectional flow area can be controlled.

The prior art mechanical drive arrangement is complex, requires a relatively large drive motor, and may not be as accurate as desired.

SUMMARY OF THE INVENTION

In a disclosed embodiment of this invention, a drive arrangement for driving diffuser vanes includes an electric motor driving a pinion gear. The pinion gear engages a curved rack section to cause a ring to rotate and pivot diffuser vanes. The compressor is mounted on air bearings, and the unique arrangement provides a compact drive arrangement.

These and other features of the present invention can be best understood from the following specification and drawings, the following of which is a brief description.

DETAILED DESCRIPTION OF THE PREFERRED EMBODIMENT

Figure 1:
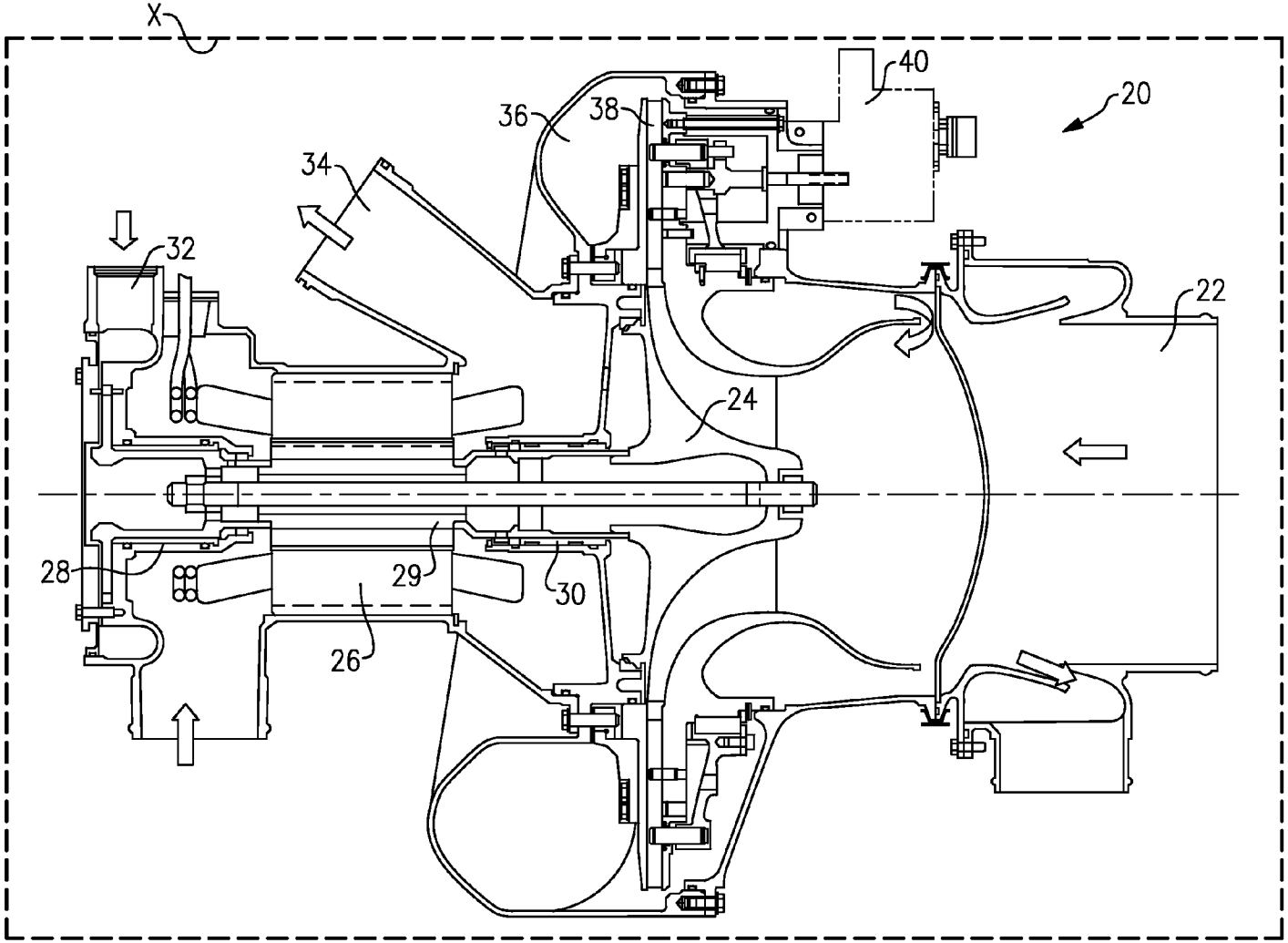
FIG. 1 schematically shows a compressor incorporating the present invention.

A compressor 20 is illustrated in FIG. 1, and may be mounted in an aircraft X, shown schematically. An inlet 22 delivers air to be compressed to a compressor impeller 24. An electric motor 26 drives the impeller 24. Air bearings 28 and 30 support the motor shaft 29 for rotation. Cooling air 32 is delivered to the air bearings from a source and passes to an outlet 34. An outlet 36 of the compressor is positioned downstream of the impeller. A diffuser 38 has a plurality of vanes (see FIG. 4) which can be pivoted to control the cross-sectional flow area. A motor 40 drives the diffuser as will be explained below.

Figure 2:
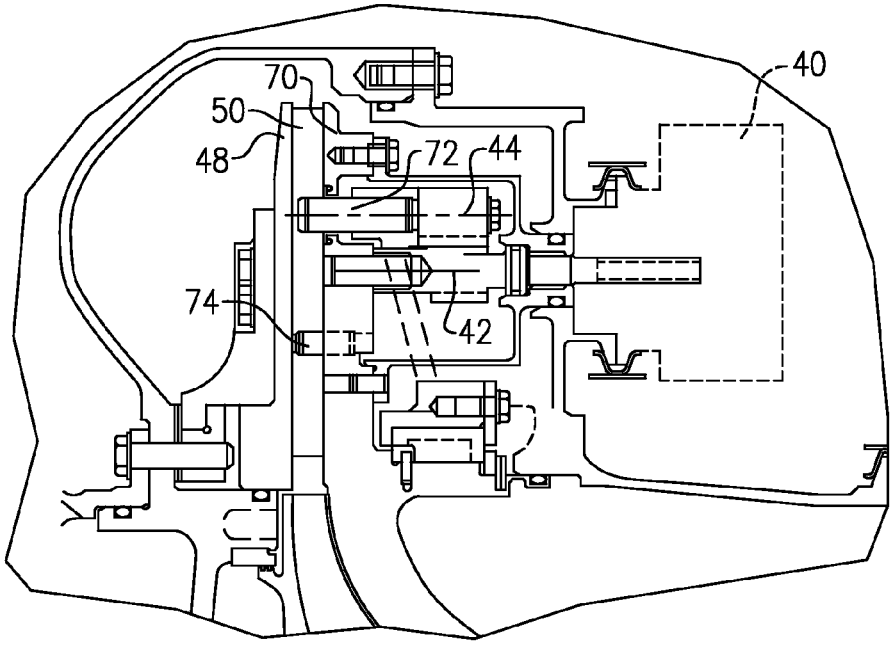
FIG. 2 is the detail of a drive arrangement for a diffuser.

As shown in FIG. 2, the motor 40 drives a pinion gear 42 that has teeth engaged with teeth on a curved rack section 44. As the pinion gear 42 rotates, it causes the curved rack section 44 to rotate. The curved rack section 44 drives a ring 70. Ring 70 carries pins 72. Pins 72, when rotated, cause diffuser vanes 50 to pivot relative to housing 48 on pins 74. As the diffuser vanes 50 pivot, the cross-sectional flow area downstream of the impeller changes.

Figure 3:
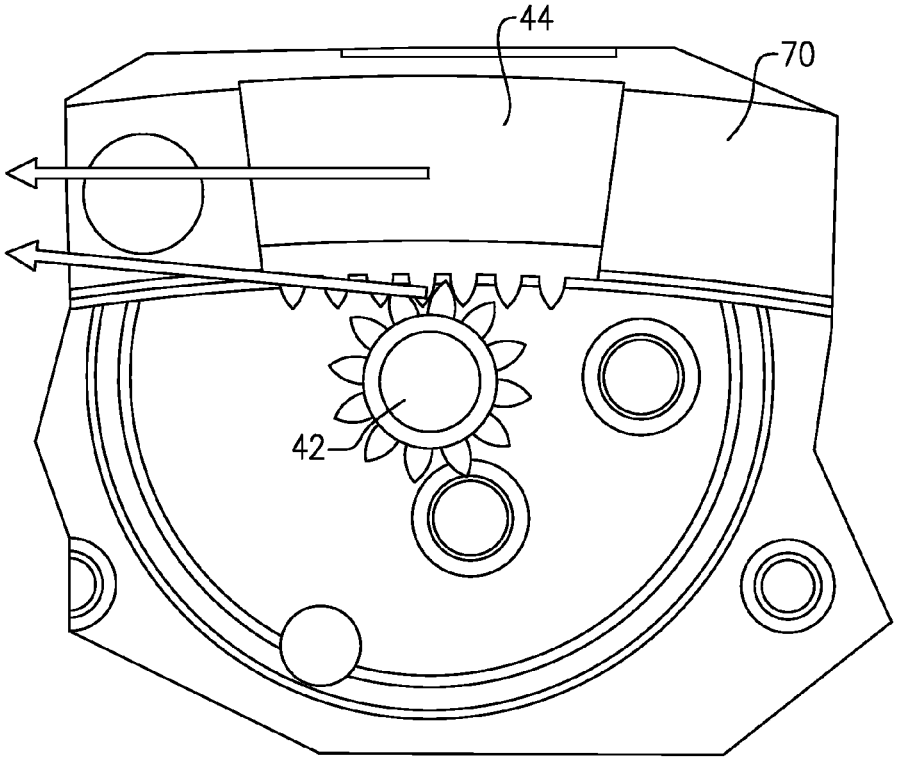
FIG. 3 shows a drive connection.

FIG. 3 shows the pinion gear 42 engaging the curved rack section 44. As shown, ring 70 carries the pins 72 (see FIG. 2) to cause the vanes 50 to pivot.

Figure 4:
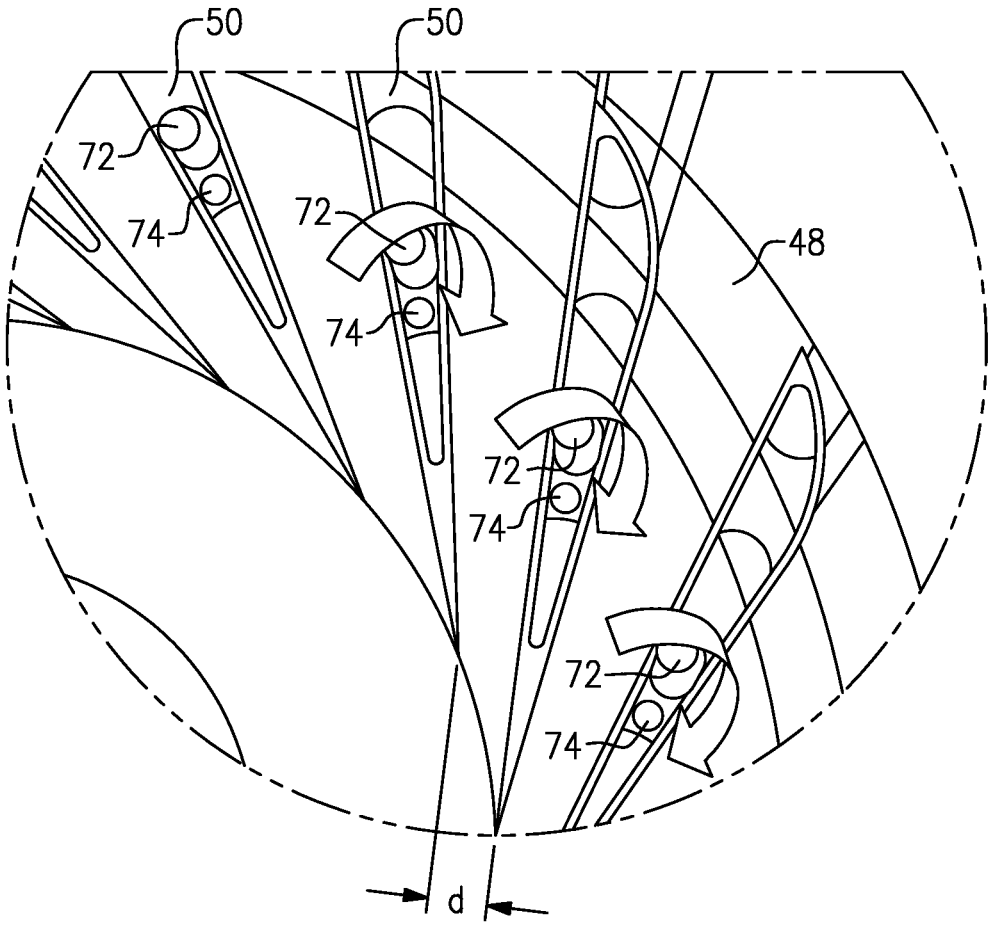
FIG. 4 shows a portion of the diffuser vane.

FIG. 4 shows the vanes 50 pivoting on the pins 74. The operation of the impeller, and the times when it might be desirable to cause the impeller vanes to pivot is as described in the above-referenced patent application. As can be appreciated, as vanes 50 pivot, they open or restrict the flow cross-section as shown by d. It is the use of the compact mechanical drive that is inventive here.

Notably, the pinion 42 is positioned radially inwardly of the curved rack section 44, thus resulting in less required space. In addition, the arrangement provides very accurate positioning of vanes 50 while utilizing a very low power motor.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

an impeller, an inlet delivering air to the impeller, and said impeller for compressing air and delivering it to an outlet;

a variable diffuser positioned downstream of the impeller and including a plurality of pivoting vanes;

a drive arrangement for pivoting said plurality of pivoting vanes, said drive arrangement including a motor causing a pinion gear to rotate, said pinion gear having gear teeth engaging gear teeth on a rack section, rotation of said rack section causing said plurality of pivoting vanes to pivot;

said impeller being mounted on air bearings;

wherein said pinion gear is positioned radially inwardly of said rack section; and wherein said pinion gear is driven by said motor, said motor being positioned on an opposed side of said pinion gear from said pivoting vanes, and said rack section being a curved rack section, with said rack section driving a ring, said ring carrying pins to cause said plurality of pivoting vanes to pivot, and said pins being positioned radially outwardly of said pinion gear.

2. An aircraft comprising:

an impeller, an inlet delivering air to the impeller, and said impeller for compressing air and delivering it to a radially outer location;

a variable diffuser positioned downstream of the impeller and including a plurality of pivoting vanes;

a drive arrangement for pivoting said plurality of pivoting vanes, said drive arrangement including a motor causing a pinion gear to rotate, said pinion gear having gear teeth engaging gear teeth on a rack section, rotation of said rack section causing said plurality of pivoting vanes to pivot;

said impeller being mounted on air bearings;

wherein said pinion gear is positioned radially inwardly of said rack section; and wherein said pinion gear is driven by said motor, said motor being positioned on an opposed side of said pinion gear from said pivoting vanes, and said rack section being a curved rack section, with said rack section driving a ring, said ring carrying pins to cause said plurality of pivoting vanes to pivot, and said pins being positioned radially outwardly of said pinion gear.

* * * * *